US006556112B1

(12) United States Patent
Van Zeeland et al.

(10) Patent No.: US 6,556,112 B1
(45) Date of Patent: Apr. 29, 2003

(54) CONVERTING A MAGNETICALLY COUPLED PUSHBUTTON SWITCH FOR TACT SWITCH APPLICATIONS

(75) Inventors: Anthony J. Van Zeeland, Mesa, AZ (US); Stefan Petrov Dikov, Glendale, AZ (US)

(73) Assignee: Duraswitch Industries Inc.

( * ) Notice: Subject to any disclaimer, the term of this patent is extended or adjusted under 35 U.S.C. 154(b) by 0 days.

(21) Appl. No.: 10/163,856

(22) Filed: Jun. 5, 2002

(51) Int. Cl.[7] ..... H01H 9/00
(52) U.S. Cl. ..... 335/205
(58) Field of Search ..... 335/205–208

(56) References Cited

U.S. PATENT DOCUMENTS 6,069,552 A * 5/2000 Van Zeeland ..... 200/512
6,392,515 B1 * 5/2002 Van Zeeland et al. ..... 335/205

* cited by examiner

*Primary Examiner*—Ramon M Barrera
(74) *Attorney, Agent, or Firm*—Scott A. Hill

(57) ABSTRACT

A magnetically coupled pushbutton switch having hard electrical conductors is discrete and may be used in place of a dome tact switch. The hard electrical conductors of the magnetically coupled pushbutton switch are uniquely arranged and may be soldered to a circuit board or surface mounted. Additionally, modifications and improvements made to the switch allow it to maintain good tactile response even though the switch may be as compact as a smaller tactile dome switch. A further benefit of the switch is its ability to be normally open, normally closed, or both. This capability stems from the unique arrangement of the hard electrical conductors that, in one preferred embodiment, extend over the top of a magnetically coupled switch armature. All of the hard electrical conductors are arranged within the switch so that the pushbutton armature of the switch is movable into and out of shorting relationship with the electrical conductors to change the circuit logic for a circuit incorporating the switch.

20 Claims, 3 Drawing Sheets

CONVERTING A MAGNETICALLY COUPLED PUSHBUTTON SWITCH FOR TACT SWITCH APPLICATIONS

BACKGROUND OF THE INVENTION

Dome tact switches are commonly used with short travel keyboards. They give a tactile feedback to a user, are compact, and are discrete. These switches have hard electrical conductors, such as stamped beryllium copper, that are soldered to a circuit board or other substrate material. Unfortunately, dome switches fracture over time and are not normally sealed offered as a normally closed switch. Magnetically coupled pushbutton switches, on the other hand, have a long life and are normally sealed, but the electrical conductors of a magnetically coupled pushbutton switch are printed or painted onto the surface of a substrate. Additionally, a magnetically coupled switch, though thin, has a larger surface area than smaller dome tact switches. There is currently no magnetically coupled pushbutton switch that is a suitable replacement for a dome tact switch primarily because of the differences in electrical conductors and size.

Magnetically coupled pushbutton switches have a metal armature that is normally held spaced from switch contacts by bonded sheet magnet. The switch contacts are usually painted or printed onto the surface of a non-conductive substrate. A non-conductive spacer layer is fixed to the substrate, with an opening in the spacer layer exposing the switch contacts. The sheet magnet overlies the spacer layer. A user-provided actuating force applied to the armature causes it to snap free of the sheet magnet and close the switch contacts by electrically connecting them. Release of the actuating force allows the sheet magnet to attract the armature back to a normal position, in coupled engagement with the sheet magnet so that the armature is spaced from the switch contacts, to reopen the switch. Preferably, the armature has a crown that protrudes through an aperture in the magnet layer. Most often, a polyester membrane layer with suitable graphics overlies the sheet magnet to direct a user of the switch as to location and function of the switch. The benefits of magnetically coupled pushbutton switches have been demonstrated in U.S. Pat. Nos. 5,523,730, 5,666,096, 5,990,772 and 6,069,552, incorporated herein by reference, but not intended to limit the scope of the present invention.

SUMMARY OF THE INVENTION

The present invention concerns a method of making a magnetically coupled pushbutton switch that is discrete and may be used in place of a dome tact switch. The method of the current invention includes hard electrical conductors that are uniquely arranged and may be soldered to a circuit board, surface mounted or insert molded. Additionally, the method of the current invention includes many modifications and improvements to a magnetically coupled pushbutton switch that allow the switch to maintain good tactile response even though the switch may be as compact as a smaller tactile dome switch.

A further benefit of the present invention is the ability of the switch to be normally open, normally closed, or both. This capability stems from the unique arrangement of the hard electrical conductors that, in one preferred embodiment, extend over the top of a magnetically coupled switch armature of the present invention. All of the hard electrical conductors are arranged within the switch so that the pushbutton armature of the switch is movable into and out of shorting relationship with the electrical conductors to change the circuit logic for a circuit incorporating the switch. An alternative construction for a normally closed switch of the present invention uses the magnetic attraction of the armature against a magnet to compress spring-loaded normally closed hard electrical conductors against a conductive surface. As used herein, the term "top" refers to that surface of any part in a cross sectional figure of the drawings that faces the top edge of the page, while "bottom" refers to that surface of any part in a cross sectional figure of the drawings that faces the bottom edge of the page.

DETAILED DESCRIPTION OF THE INVENTION

Figure 1:
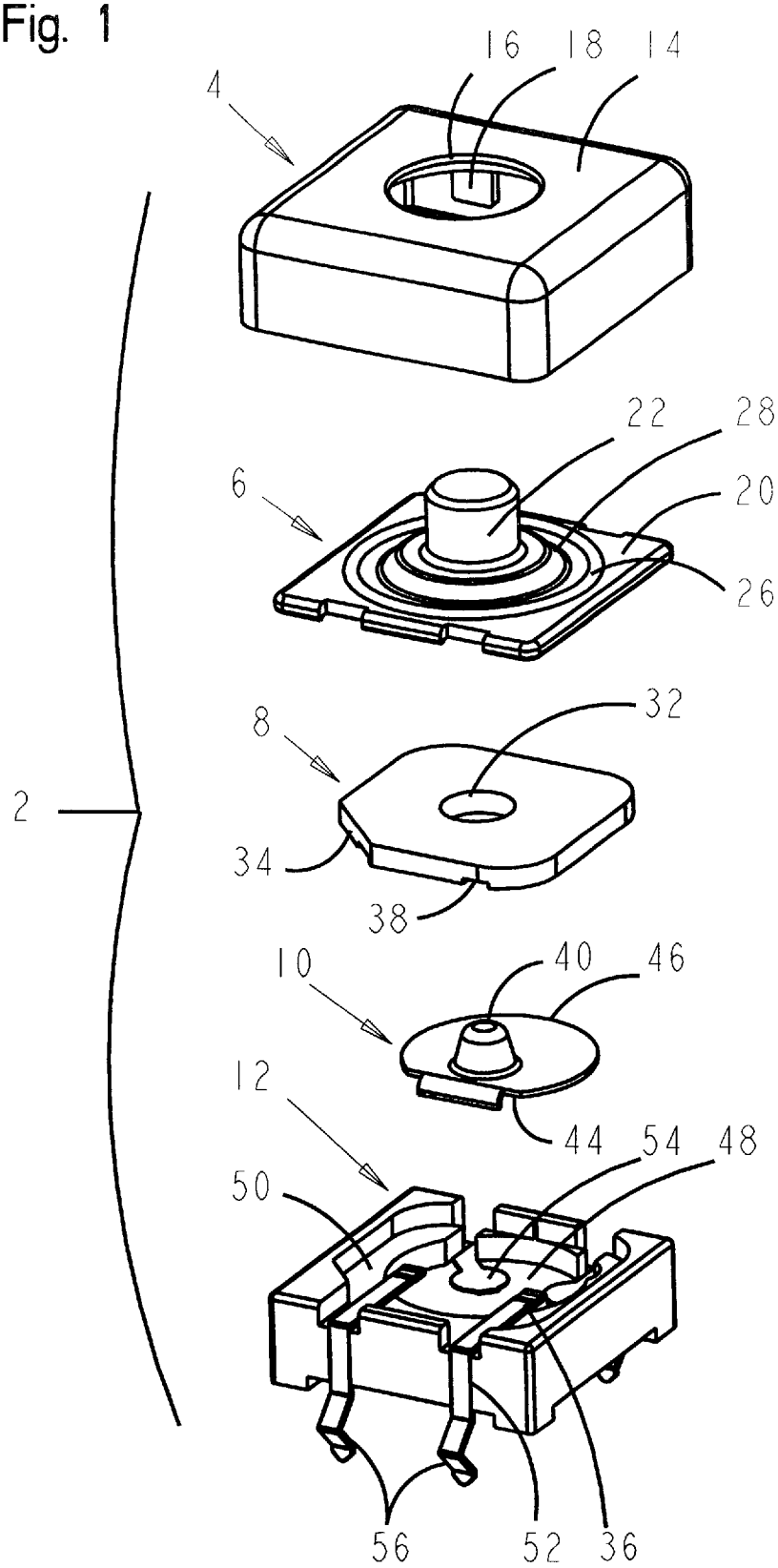
FIG. 1 is an exploded perspective view of a switch according to the present invention.
Figure 2:
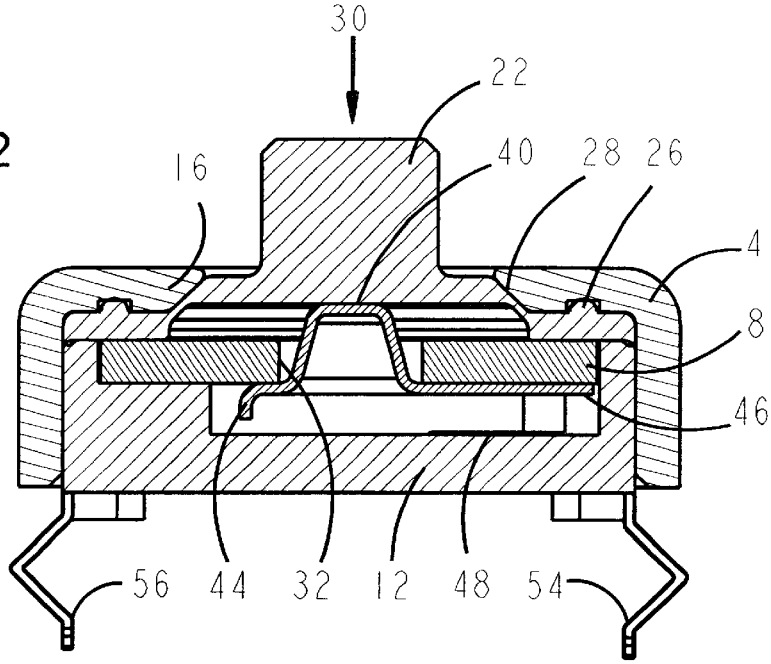
FIG. 2 is a cross-section of the switch of FIG. 1.

As shown in FIGS. 1 and 2, the magnetically coupled pushbutton switch of the present invention, shown generally at 2, requires, from the top down, a top cover 4, a button 6, a magnet 8, an armature 10, and a base housing 12 that accepts hard electrical conductors. There are several additional features shown and described in the foregoing description that, though preferred, are not necessary and may be excluded where cost or preference dictates otherwise. FIGS. 1 and 2 show how a magnetically coupled pushbutton switch would appear if the most preferred embodiment of the present invention were used. Preferred materials, shapes, methods of attachment and methods of assembly will be discussed, but these preferences are not intended to exclude suitable or functionally equivalent alternatives.

The top cover 4 has a substantially square top surface 14 with a cover aperture 16 that is centrally located. There are four sides that extend downwardly from the four sides of the top surface 14. Ideally, the top cover 4 is molded from a material such as nylon or acetal, but there are numerous other rigid materials, such as steel, that may also be used to make the top cover 4. Also, where appropriate, the top cover 4 may be stamped, machined, or otherwise formed. For quality control purposes, two of the sides of the top cover 4 have raised alignment tracks 18 that are used to align a button 6.

The button 6 includes a support structure 20 that aligns with the top cover 4 so that a central pad portion 22 of the button 6 extends through the central cover aperture 16 of the top cover 4. The button 6 is made from an elastic and flexible material, such as silicone rubber or an elastomer. The support structure 20 of the button 6 includes alignment notches 24 that align with the raised alignment tracks 18 of the top cover 4. The top of the support structure 20 includes a seal ridge 26 that completely contacts the top cover 4 after assembly. The seal ridge 26 prevents contaminants from entering the switch. The support structure 20 additionally includes concentric deformable ridges 28 centered around the central pad portion 22 of the button 6 so the central pad portion can be easily depressed when a user provided actuation force 30 is applied, causing the central pad portion to travel down through the cover aperture 16 in the top cover 4, and return up through the cover aperture when the user provided actuation force is removed.

Figure 3:
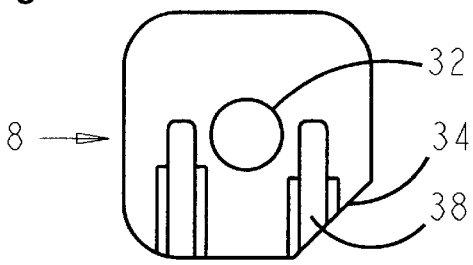
FIG. 3 is a plan view showing the bottom of a molded magnet for a switch according to the present invention that has a normally closed set of hard electrical conductors.
Figure 6:
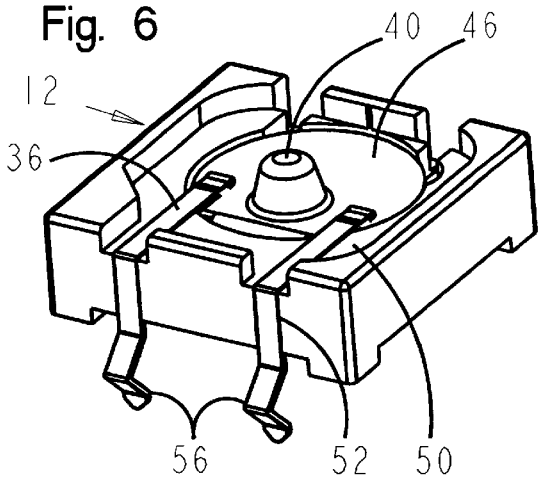
FIG. 6 is a perspective view of an armature nestled in a base housing for a switch according to the present invention having normally closed hard electrical conductors.
Figure 4:
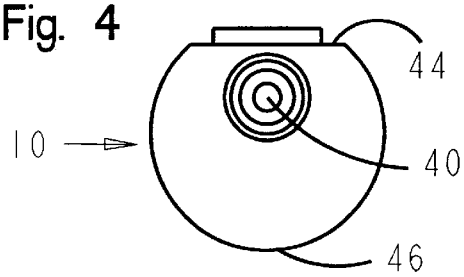
FIG. 4 is a plan view of a stamped armature for a switch according to the present invention.

There is a magnet 8 below the button 6, the magnet having a magnet aperture 32 that is substantially centered under the central pad portion 22 of the button 6. The magnet 8 is preferably extruded, calendered or molded magnet that has a substantially flat bottom surface. Neodymium Iron Boron (NdFeB) or Samarium Cobalt (SmCo5) should be used for more compact switch designs because those materials have a stronger magnetic holding force than the more commonly used barium ferrite sheet magnet material. Extruded or calendered sheet magnet may be machined or blade cut with a magnet aperture 32 and, for alignment purposes, a trimmed corner 34. Extruded or calendered sheet magnet is appropriate for a norm ally open switch or a normally closed switch that utilizes printed electrical conductor pads on the bottom surface of the magnet 8. Injection molded magnet 8, like the one shown in FIGS. 1 and 3, is appropriate for a normally closed switch that has hard electrical conductor prongs 36, as will be described later. There are channels 38 formed in the injection molded magnet 8 that accept the prongs 36 of a normally closed switch.

An armature 10, made from magnetic material, is normally magnetically coupled to the bottom surface of the magnet 8. The armature 10 has a crown 40 that is off-center and normally protrudes through the magnet aperture 32 so that the crown 40 nearly or minimally touches the bottom of the central pad portion 22 of the button 6. Alternatively, the bottom of the central pad portion 22 of the button 6 may have an actuating post, or tappet, integrally formed into the button piece part such that the tappet depends through the magnet aperture 32 and performs the same function as the crown 40 of the armature 10 so that a crown is not necessary. Because crowns are more commonly used, this description will utilize a crown instead of a tappet. The outer perimeter of the armature 10 that is closest to the crown 40 is the heel end 44 of the armature, while the outer perimeter of the armature that is farthest from the crown is the toe end 46 of the armature. If the armature 10 is generally disc shaped, which is preferred but not necessary, the heel end 44, crown 40 and toe end 46 of the armature are substantially centered along a single diameter of the armature. Using NdFeB magnet, a disc shaped armature can range as small as about one quarter inch in diameter and yet require an actuation force of about ten ounces.

There is a base housing 12 below the armature 10, the base housing typically being machined from a material like the ones already mentioned as appropriate materials for the top cover 4 so long as it is not electrically conductive. There is a cavity 48 in the middle of the base housing 12 that houses the armature 10 such that the armature has enough freedom of movement to allow for proper switch travel. At the top of the base housing 12 there is a platform 50 that is broader than the cavity 48. The platform 50 is about as deep as the thickness of the magnet 8 and the platform is shaped to accept an aligned magnet 8 having a trimmed corner 34 such that the top of the magnet assembles flush with the top of the base housing 12. Because the platform 50 is broader than the cavity 48, the base housing 12 at least supports the outer perimeter of the bottom of the magnet 8. Grooves 52 that accept hard electrical conductor prongs 36 of the switch are an additional base housing 12 feature. A simple way to assemble the base housing 12 to the top cover 4 would be a snap fit, which is ideal because of the flexible nature of the button's seal ridge 26. After assembly, the top of the base housing 12 firmly presses against the support structure 20 of the button 6, especially against the seal ridge 26.

Figure 5:
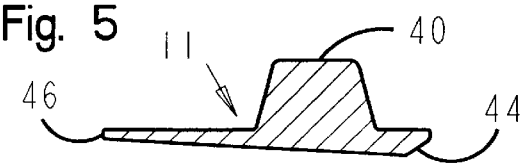
FIG. 5 is a cross section of a machined armature.
Figure 8:
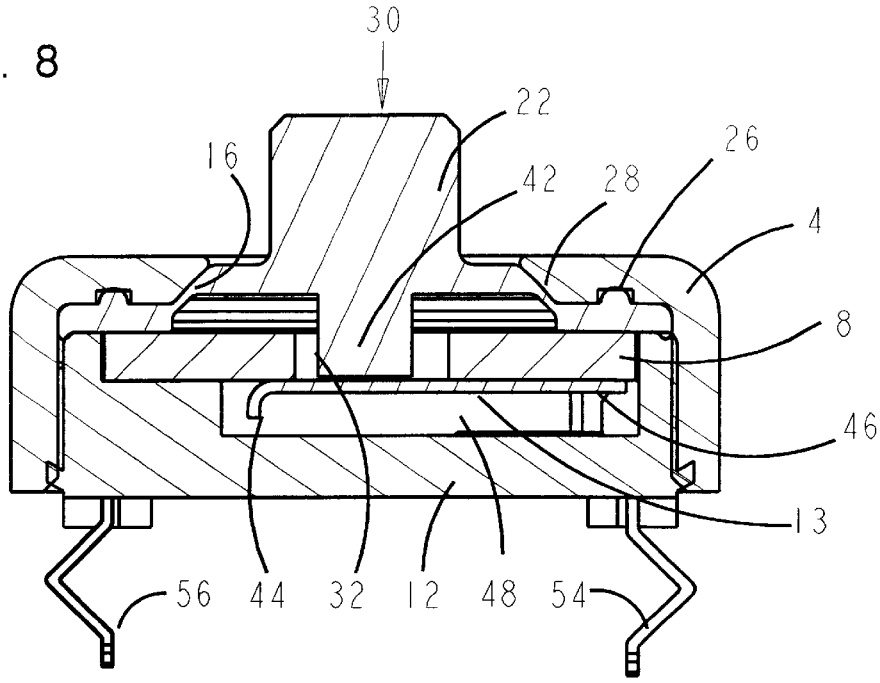
FIG. 8. is a cross-sectional elevation, similar to FIG. 2, but the button includes a tappet that depends through the magnet aperture.
Figure 9:
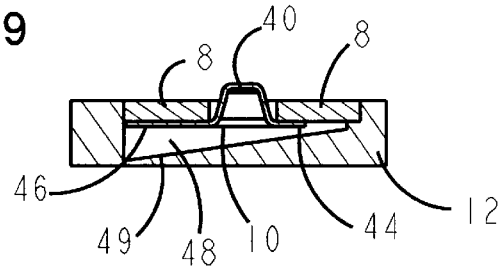
FIG. 9 is a cross-sectional elevation of a base housing, with magnet and armature, having a cavity with a top and bottom that are sloped with respect to each other so that the heel end of the armature has very little range of motion.
Figure 10:
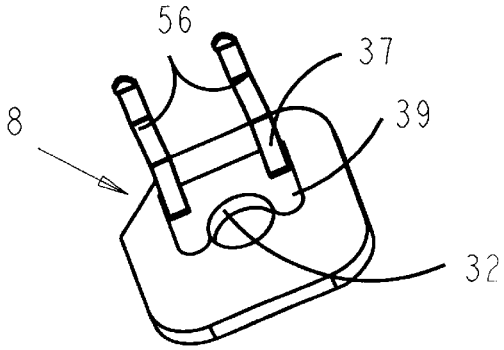
FIG. 10 is a perspective view of a magnet having painted electrical conductor pads that are in electrical contact with short prongs of normally closed hard electrical conductors.
Figure 11:
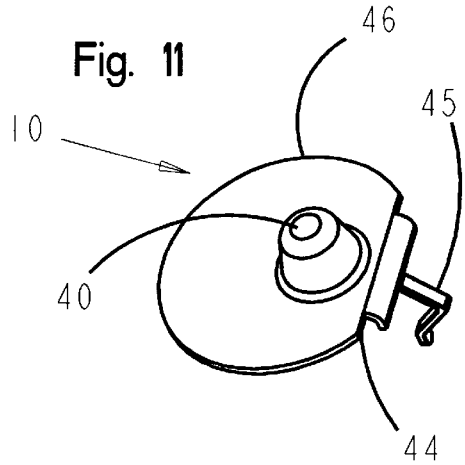
FIG. 11 is a perspective view of an armature having a hard electrical conductor formed as an extension of the heel end of the armature.

During switch actuation, movement of the armature 10 is such that the heel end 44 breaks away from the magnet 8 until it meets the bottom of the cavity 48 in the base housing 12. Subsequently, the armature 10 pivots about the heel end 44 of the armature so that the toe end 46 of the armature breaks away from the magnet 8 and travels to the bottom of the cavity 48. To prevent a double tactile feedback caused by both the heel end 44 and toe end 46 abruptly contacting the bottom of the cavity 48, the travel of the heel end should be shortened so that only the longer traveling toe end provides any noticeable tactile feedback. As shown in FIG. 5, this may be accomplished by machining an armature 11 so that it is tapered in thickness such that the heel end 44 of the armature is significantly thicker than the toe end 46 of the armature 11. Alternatively, for cost savings, the armature may be stamped from sheet metal. A stamped armature 10, like the one shown in FIGS. 1, 2, 4 and 6, has its heel end 44 bent at a significant angle, roughly ninety degrees. The bent heel end 44 has a flat edge that is normally held slightly spaced from the bottom of the cavity 48. An alternative construction of the cavity 48 could accomplish the same goal as the above mentioned armature designs. If the bottom of the cavity 48 includes an incline such that the volume of the cavity that accepts the heel end 44 of the armature 10 is shallower than the volume of the cavity that accepts the toe end 46 of the armature, then the resulting sloped, or wedge shaped, cavity eliminates the need for a bent heel end 44 on the armature.

The hard electrical conductors of the switch may be arranged so that the switch is normally open, normally closed, or both, and they may be plated with silver, gold or the like. Hard electrical conductors may made from any electrically conductive material that may be stamped or otherwise formed into a piece part, as distinguished from painted or printed electrical conductors. The hard electrical conductors may be insert molded into the base housing 12, or otherwise secured. Normally open hard electrical conductors 54 may be formed as pins with broad heads that poke through the bottom of the cavity 48, with the broad heads usually sitting on the bottom of the cavity so that they may be electrically contacted by the armature 10 during switch actuation. Alternatively, the normally open hard electrical conductors 54 are stamped from electrically conductive sheet metal, such as beryllium copper, and then pre-bent and placed in the channels 38 in the base housing 12 designed to accept and hold the normally open hard electrical conductors 54. There are usually two hard electrical conductors that are electrically connected by the toe end 46 of the armature 10 when a user provided force causes the armature to travel toward the bottom of the cavity 48 in the base housing 12. The prongs 36 of the normally open hard electrical conductors 54 may be slightly spring-loaded so that the prongs, extensions of the hard electrical conductors that are normally touched by the toe end 46 of the armature 10 during switch actuation, are slightly spaced from the bottom of the cavity 48, but the prongs 36 are also spaced from the armature when the switch is in an un-actuated position. By spring loading the prongs 36 of the normally open hard electrical conductors 54, if the armature 10 touches one of the prongs before the other, then the armature is able to continue to travel until there is positive switch contact with the other prong. At the end of switch travel the user provided actuation force 30 resists the spring force of the two prongs 36 until they reach the bottom of the cavity 48 in the base housing 12.

Where the switch includes normally closed hard electrical conductors 56, electrical contact is made when the armature 10 is magnetically coupled to the magnet 8. In one preferred embodiment, the normally closed hard electrical conductors 56 are stamped, similar to the normally open hard electrical conductors 54 above, and then place in grooves 52 in the base housing 12 designed to accept and hold the normally closed hard electrical conductors. Again, insert molding would be a suitable method of securing the hard electrical conductors to the base housing. The prongs 36 of the normally closed hard electrical conductors 56 may extend over the heel end 44 and or toe end 46 of the armature 10. Molded magnet 8 is used in this embodiment so that the prongs 36 fit into the channels 38 formed in the molded magnet. The channels 38 are deep enough so that the prongs 36 do not significantly interfere with the coupled engagement of the armature 10 to the magnet 8, but the prongs definitely touch the top of the armature when the switch is in the un-actuated position. To assemble the armature 10 between the base housing 12 and prongs 36, it may be necessary to bend the prongs after the armature is positioned in the cavity 48 of the base housing. Alternatively, the grooves 52 in the base housing 12 could allow for the prongs 36 to be placed in a pre-bent state and then the top cover 4 to secure the assembly. Yet another possible assembly method would be to slip the armature 10 into place.

Figure 7:
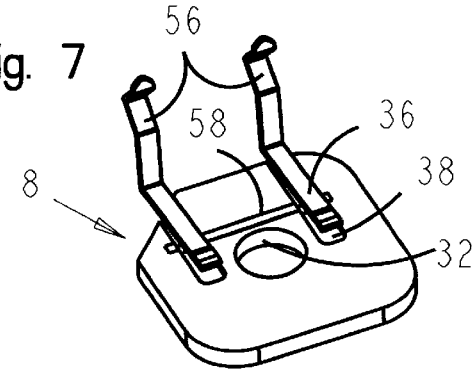
FIG. 7 is a perspective view of the bottom of a spring-loaded normally closed electrical conductor arrangement according to the present invention.

FIG. 7 shows an alternative embodiment very similar to the one just described, with the normally closed electrical conductors 56 slightly spring-loaded so that, in the absence of an armature, the prongs 36 are at least partially spaced from the channels 38 formed in the molded magnet 8. An electrically conductive material, such as a copper bar that is molded into the magnet or a silver paint line 58 applied to the bottom of the magnet, electrical connects the channels 38. When an actuation force is holding the armature spaced from the magnet, the prongs are spaced from the electrically conductive material that connects the channels. When the actuation force is removed so that the armature is magnetically attracted to the magnet, the magnetic attractive force overcomes the spring force of the prongs so that the prongs are pressed into the channels. In the normally closed position, the prongs are electrically connected by the electrically conductive material that connects the channels.

In another preferred embodiment, the normally closed hard electrical conductors 56 are formed as above, except the prongs are short and do not extend over the armature 10. The bottom surface of the magnet 8, which may be calendered or extruded sheet magnet, has printed or painted electrical conductor pads. The short prongs are in constant electrical contact with the electrical conductor pads on the magnet 8. One drawback to this design is that painted or printed electrical conductors are not capable of carrying higher currents, which was one of the drawbacks of the prior art. Yet another embodiment, for use with any of the hard electrical conductor arrangements, has a common hard electrical conductor that may be formed by including an extension off the bent heel end 44 of a stamped armature 10, the extension protruding to an appropriate location external to the base housing 12 where the extension may be used as the common hard electrical conductor of either a set of normally open or normally closed hard electrical conductors 56, or both. The extension may be a pin or a long and narrow piece of armature material that is similar, in size and shape, to one of the normally closed hard electrical conductors 56.

While a preferred form of the invention has been shown and described, it will be realized that alterations and modifications may be made thereto without departing from the scope of the following claims.

What is claimed is:

1. A method of making a discrete magnetically coupled pushbutton switch, comprising the steps of:

making a top cover out of a rigid material, the top cover having a cover aperture;

forming a button out of a flexible and elastic material, the button having a support structure and a central pad portion;

making a magnet with a magnet aperture;

forming an armature, with a heel end and a toe end, from a magnetic material;

making a base housing that has a cavity and a platform;

forming a set of normally closed hard electrical conductors;

assembling the set of normally closed hard electrical conductors to the base housing;

placing the armature substantially in the cavity in the base housing;

placing the magnet substantially on the platform in the base housing;

assembling the button to the top cover so that the central pad portion at least partially protrudes through the cover aperture; and attaching the top cover to the base housing so that the support structure of the button is intermediate the top cover and the magnet that is on the platform in the base housing.

2. The method of claim 1 wherein the step of forming the set of normally closed hard electrical conductors is characterized by forming long prongs; the step of making the magnet is further characterized by molding the magnet to additionally comprise channels; and the step of assembling the set of normally closed hard electrical conductors is characterized by orienting the long prongs in the channels so that when the top cover is attached to the base housing, the long prongs are normally electrically closed by the armature.

3. The method of claim 1 wherein the step of forming the set of normally closed hard electrical conductors is characterized by forming short prongs; the step of making the magnet is further characterized by forming electrical conductor pads onto the magnet; and the step of assembling the set of normally closed hard electrical conductors is characterized by orienting the short prongs to electrically contact the electrical conductor pads so that when the top cover is attached to the base housing, the electrical conductor pads are normally electrically closed by the armature.

4. The method of claim 1 wherein the step of making the base housing that has a cavity is characterized by making the cavity with a top and bottom that are sloped with respect to each other so that the heel end of the armature has very little range of motion from the top of the cavity to the bottom of the cavity, but the toe end of the armature has a substantial range of motion from the top of the cavity to the bottom of the cavity.

5. The method of claim 1 wherein the step of forming the armature is characterized by stamping the armature from sheet metal so that the heel end of the armature is normally in a position that is bent away from the magnet.

6. The method of claim 5 further characterized by forming one of the normally closed hard electrical conductors in the set as an extension of the heel end of the armature that is in constant electrical contact with the armature.

7. The method of claim 1 wherein the step of forming the button is further characterized by forming a tappet that, when the switch is assembled, depends through the magnet aperture.

8. The switch of claim 1 wherein the step of making the armature is further characterized by making a crown that normally protrudes through the magnet aperture.

9. A method of making a discrete magnetically coupled pushbutton switch, comprising the steps of:

making a top cover out of a rigid material, the top cover having a cover aperture;

forming a button out of a flexible and elastic material, the button having a support structure and a central pad portion;

making a magnet with a magnet aperture;

forming an armature, with a heel end and a toe end, from a magnetic material;

making a base housing that has a cavity and a platform;

forming a set of normally open hard electrical conductors with prongs;

assembling the set of normally open hard electrical conductors so that the prongs are substantially inside the base housing;

placing the armature substantially in the cavity in the base housing;

placing the magnet substantially on the platform in the base housing;

assembling the button to the top cover so that the central pad portion at least partially protrudes through the cover aperture; and attaching the top cover to the base housing so that the support structure of the button is intermediate the top cover and the magnet that is on the platform in the base housing.

10. The method of claim 9 wherein the step of assembling the set of normally open hard electrical conductors is characterized by orienting the normally open hard electrical conductors substantially intermediate the toe end of the armature and the base housing.

11. The method of claim 9 wherein the step of making the base housing that has a cavity is characterized by making the cavity with a top and bottom that are sloped with respect to each other so that the heel end of the armature has very little range of motion from the top of the cavity to the bottom of the cavity, but the toe end of the armature has a substantial range of motion from the top of the cavity to the bottom of the cavity.

12. The method of claim 9 wherein the step of forming the armature is characterized by stamping the armature from sheet metal so that the heel end of the armature is normally in a position that is bent away from the magnet, and further characterized by forming one of the normally open hard electrical conductors in the set as an extension of the heel end of the armature that is in constant electrical contact with the armature.

13. The method of claim 9 wherein the step of forming the button is further characterized by forming a tappet that, when the switch is assembled, depends through the magnet aperture.

14. The method of claim 9 wherein the step of assembling the normally open hard electrical conductors is further characterized by spring loading the prongs so that they are not normally resting against the base housing.

15. A discrete magnetically coupled pushbutton switch comprising:

a top cover made out of a rigid material, the top cover having a cover aperture;

a button made out of a flexible and elastic material, the button having a support structure and a central pad portion, the central pad portion at least partially protruding into the cover aperture;

a magnet with a magnet aperture;

an armature, with a heel end and a toe end, made from a magnetic material;

a base housing that has a cavity that substantially houses the armature, and a platform that accepts the magnet;

a magnetic attractive force between the magnet and the armature that causes the armature to normally be held in coupled engagement with the magnet;

a set of hard electrical conductors that is at least partially held by the base housing so that an end of each hard electrical conductor in the set extends away from the base housing such that each end is capable of being soldered to a circuit board;

a means of attaching the top cover to the base housing so that the support structure of the button is intermediate the top cover and the magnet, and the armature is intermediate the magnet and the base housing; and a user applied force that, when applied through the cover aperture, causes the armature to break away from the coupled engagement with the magnet.

16. The switch of claim 15 wherein the button further comprises a post that depends through the magnet aperture such that the user applied force directs the post through the magnet aperture to cause the armature to break away from the coupled engagement with the magnet.

17. The switch of claim 15 further comprising:

channels formed in the magnet;

prong portions on the hard electrical conductors;

a conductive material that electrically connects at least part of the channels to each other; and a spring loading force that is capable of at least partially spacing the prong portions from the conductive material when the user applied force is applied, but the spring loading force is not strong enough to hold the prong portions spaced from the conductive material when the magnetic attractive force causes the armature to normally be held in coupled engagement with the magnet such that the prong portions are physically forced by the armature into the channels.

18. The switch of claim 15 wherein the armature is formed by being stamped from sheet metal so that the heel end of the armature is normally in a position that is bent away from the magnet.

19. The switch of claim 18 wherein one of the hard electrical conductors in the set is integrally formed as an extension of the heel end of the armature, in constant electrical contact with the armature.

20. The switch of claim 15 wherein the cavity that substantially houses the armature has a top and bottom that are sloped with respect to each other so that the heel end of the armature has very little range of motion from the top of the cavity to the bottom of the cavity, but the toe end of the armature has a substantial range of motion from the top of the cavity to the bottom of the cavity.

* * * * *